US007374332B2

(12) United States Patent
Higashino et al.

(10) Patent No.: US 7,374,332 B2
(45) Date of Patent: May 20, 2008

(54) METHOD, DEVICE AND SYSTEM FOR MIXING LIQUIDS

(75) Inventors: Kusunoki Higashino, Osaka (JP); Yasuhiro Sando, Amagasaki (JP); Nobuhisa Ishida, Kyoto (JP)

(73) Assignee: Konica Minolta Holdings, Inc., Tokyo (JP)

( * ) Notice: Subject to any disclaimer, the term of this patent is extended or adjusted under 35 U.S.C. 154(b) by 261 days.

(21) Appl. No.: 10/970,324

(22) Filed: Oct. 21, 2004

(65) Prior Publication Data

US 2005/0092681 A1 May 5, 2005

(30) Foreign Application Priority Data

Oct. 30, 2003 (JP) ..... 2003-371135

(51) Int. Cl.
*B01F 3/08* (2006.01)

(52) U.S. Cl. ..... 366/179.1; 137/602

(58) Field of Classification Search . 366/DIG. 1–DIG. 4, 179.1; 137/602, 896, 897
See application file for complete search history.

(56) References Cited

U.S. PATENT DOCUMENTS 154,544 A * 9/1874 Doten ..... 366/167.1
2,999,673 A * 9/1961 Kessler ..... 366/162.1
5,858,187 A * 1/1999 Ramsey et al. ..... 204/452
6,082,891 A 7/2000 Schubert et al. ..... 366/338
6,120,666 A * 9/2000 Jacobson et al. ..... 204/452
6,200,814 B1 * 3/2001 Malmqvist et al. ..... 436/52
6,238,538 B1 * 5/2001 Parce et al. ..... 204/600
7,160,423 B2 * 1/2007 Chien et al. ..... 204/453
2003/0207338 A1 * 11/2003 Sklar et al. ..... 435/7.21

FOREIGN PATENT DOCUMENTS

| | | |
|---|---|---|
| JP | 10-512197 | 11/1998 |
| JP | 2002-503336 | 1/2002 |
| JP | 2003-220322 | 8/2003 |
| WO | WO 98/52691 | 11/1998 |

* cited by examiner

*Primary Examiner*—David Sorkin
(74) *Attorney, Agent, or Firm*—Sidley Austin LLP

(57) ABSTRACT

A method and a device are provided which can mix two liquids faster at a precise mixing ratio. The method for mixing at least two liquids transported in respective channels includes transporting, of the two liquids, a liquid having a low mixing rate intermittently in one of the channels, and transporting, of the two liquids, a liquid having a high mixing rate so as to join the liquid having a low mixing rate from both sides of the channel for the liquid having a low mixing rate.

7 Claims, 15 Drawing Sheets

METHOD, DEVICE AND SYSTEM FOR MIXING LIQUIDS

This application is based on Japanese Patent Application No. 2003-371135 filed on Oct. 30, 2003, the contents of which are hereby incorporated by reference.

BACKGROUND OF THE INVENTION

1. Field of the Invention

The present invention relates to a mixing method, a mixing device and a mixing system for mixing a small amount of liquid and a small amount of another liquid in a microfluidic system or the like.

2. Description of the Related Art

In recent years, a μ-TAS (Micro Total Analysis System) has drawn attention that uses a micromachining technique to microfabricate equipment for a chemical analysis or a chemical synthesis and then to perform the chemical analysis or the chemical synthesis in a microscale method. Compared to the conventional systems, a miniaturized μ-TAS has advantages in that required sample volume is small, reaction time is short, the amount of waste is small and others. The use of the μ-TAS in the medical field lessens the burden of patients by reducing volume of specimen such as blood, and lowers the cost of examination by reducing reagent volume. Further, the reduction of the specimen and reagent volume causes reaction time to shorten substantially, ensuring that examination efficiency is enhanced. Moreover, since the μ-TAS is superior in portability, it is expected to apply to broad fields including the medical field and an environmental analysis.

The present applicants have made various studies focusing attention on effects of microscale that is one of features of the μ-TAS due to the small dimensions. Since in the field of microchannel, dimensions are extremely small, flow velocity is extremely low and the Reynolds number is 200 or less, laminar flow should be expected, instead of turbulent flow in conventional reactors. Microspace is advantageous to diffusion and mixing in an interface with which laminar flow comes into contact, due to a large interfacial area in the microspace. The time required for mixing depends on a cross-sectional area of an interface with which two liquids come into contact and a thickness of a liquid layer. More specifically, according to a diffusion theory, the time T required for mixing is proportional to $W^2/D$ where a thickness of a liquid layer (a channel width) is denoted by W and diffusivity is denoted by D. Accordingly, when two liquids are flowed in channels in the form of laminar flow, the smaller a channel width is, the faster mixing (diffusion) time is. Further, the diffusivity D is derived from the following equation.

$$(D=\kappa b\times T)/(6\times\pi\times\mu\times r)$$

where T, μ, r, and κb represent liquid temperature, viscosity, particle radius and Boltzmann constant, respectively.

In short, molecule transport, reactions and separation are smoothly performed only by voluntary action of molecules or particles in a microspace without the use of mechanical agitation.

Further, conventionally, there are proposed an apparatus in which channels are crossed with one another in three dimensions for improvement in mixing efficiency (JP Patent No. 3119877) and an apparatus in which diffusion in the channel width direction is basically used and channels join together to carry out mixing (National Publication of International Patent Application No. PCT/CA98/00481).

As described above, conventionally, a study relating to a type of diffusion in the channel width direction is published and, in such a study, channels having a width of approximately 100 μm are the mainstream. In some applications, however, a problem arises of requiring a lot of time in the case of mixing by voluntary diffusion using channels having a width of 100 μm or so. Such a problem arises, for example, when a particle diameter is large. Further, when a reaction starts at the moment of interflow of liquids, the reaction proceeds prior to sufficient mixing, so that results in line with expectations cannot be obtained. In the event that a distance is short between a mixing portion and a detection portion, it is necessary to complete mixing in an extremely short time. To this end, a method is conceivable of reducing a channel width in order to shorten mixing time. Such a method, however, causes channel resistance to increase, leading to the difficulty in control of liquid transport.

Accordingly, the present applicants previously proposed a method for greatly reducing mixing time by forming extremely thin laminar streams along the flow direction of channels (Japanese unexamined patent publication No. 2003-220322).

According to the method previously proposed by the present applicants, when a mixing ratio is close to 1:1, mixing can be performed at a precise mixing ratio in a short time. When a mixing ratio is far from 1:1, however, it was found that uniform mixing is difficult at an intended mixing ratio due to influences of channel walls on a liquid having a smaller mixing ratio of two liquids as shown in FIG. 14.

Additionally, even if a ratio of amount of transported liquids is an intended value, there are some problems, including a problem that unevenness of concentration easily occurs in the channel width direction and a problem that it takes a lot of time to eliminate the unevenness of concentration by voluntary diffusion to provide uniform concentration.

SUMMARY OF THE INVENTION

The present invention is directed to solve the problems pointed out above, and therefore, an object of the present invention is to mix two liquids faster at a precise mixing ratio compared to conventional methods. Another object of the present invention is to minimize unevenness of concentration in the channel width direction.

According to one aspect of the present invention, a method for mixing at least two liquids transported in respective channels includes transporting, of the two liquids, a liquid having a low mixing rate intermittently in one of the channels, and transporting, of the two liquids, a liquid having a high mixing rate so as to join the liquid having a low mixing rate from both sides of the channel for the liquid having a low mixing rate.

Preferably, the liquid having a high mixing rate is transported from two symmetrical channels with respect to a confluent portion with the channel for the liquid having a low mixing rate and the liquid having a high mixing rate is transported from the two symmetrical channels by an equal amount.

Further, the liquid having a high mixing rate is transported so as to join the liquid having a low mixing rate at two positions of the channel for the liquid having a low mixing rate, the two positions being different from each other.

According to another aspect of the present invention, a device for mixing at least two liquids includes a first channel for transporting one of the two liquids, a second channel for transporting the other liquid, and a third channel extending from a confluent portion of the first channel and the second channel to an extension of the first channel. The second channel is made up of two channels and the two channels are formed so as to join from both sides of the first channel at the confluent portion in a symmetrical manner.

Further a device for mixing at least two liquids includes a first channel for transporting one of the two liquids, a second A channel and a second B channel for transporting the other liquid respectively, and a third channel extending from a confluent portion of the first channel and the second A channel to an extension of the first channel. The second B channel is formed so as to join the third channel from a direction opposite to the second A channel.

According to yet another aspect of the present invention, a system for mixing at least two liquids, includes a first channel for transporting one of the two liquids, a second channel for transporting the other liquid, a third channel extending from a confluent portion of the first channel and the second channel to an extension of the first channel, a first pump for transporting the one of the two liquids to the first channel intermittently, and a second pump for transporting the other liquid to the second channel intermittently. The second channel is made up of two channels and the two channels are formed so as to join from both sides of the first channel at the confluent portion in a symmetrical manner, the first pump and the second pump are so controlled that the first pump and the second pump transport the one liquid and the other liquid respectively to the confluent portion alternately, and control is so made that amount of liquid transport by the first pump is smaller than amount of liquid transport by the second pump.

Preferably, the first channel and the second channel are formed so as to have respective narrow channel widths at the confluent portion and its vicinity.

Further, control is so made that amount of liquid transport at one time by intermittent liquid transport using the first pump is larger than a volume of a space of the confluent portion.

In addition, the first pump is so controlled that a slight pressure is generated in order to prevent backflow of the first liquid at a time when intermittent liquid transport of the first liquid is stopped.

It is not necessarily that a single first pump and a single second pump are provided. A plurality of first pumps and/or a plurality of second pumps may be provided.

The present invention enables mixing of two liquids faster at a precise mixing ratio compared to conventional cases. In addition, the present invention allows for minimization of unevenness of concentration in the channel width direction.

These and other characteristics and objects of the present invention will become more apparent by the following descriptions of preferred embodiments with reference to drawings.

DESCRIPTION OF THE PREFERRED EMBODIMENTS

First Embodiment

Figure 1:
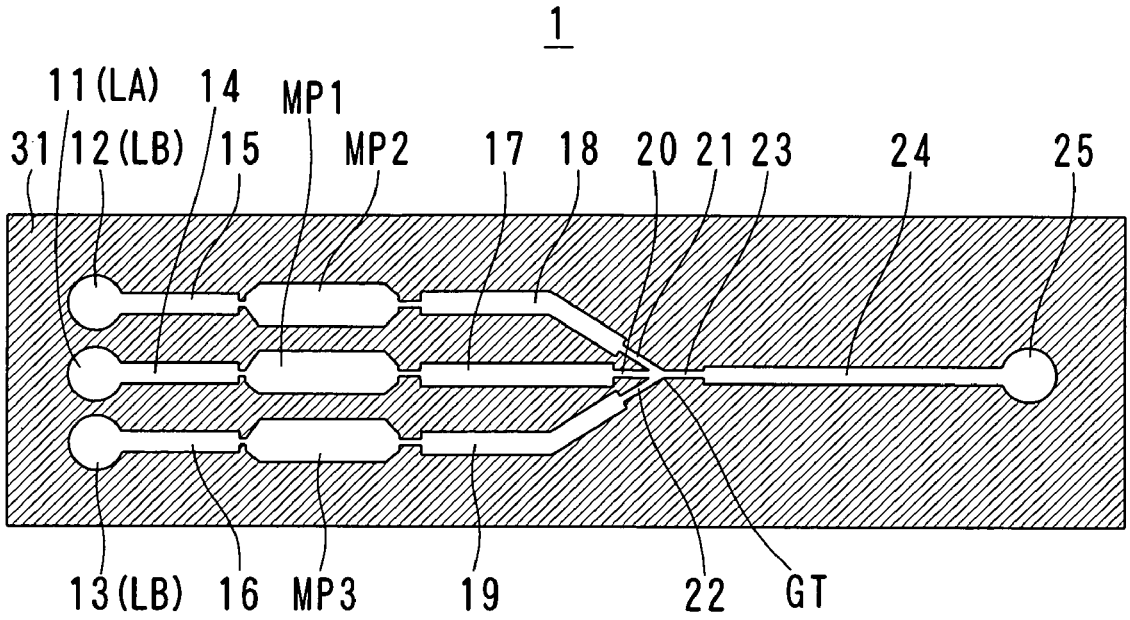
FIG. 1 is a plan view showing a structure of a microfluidic system according to a first embodiment.
Figure 2:
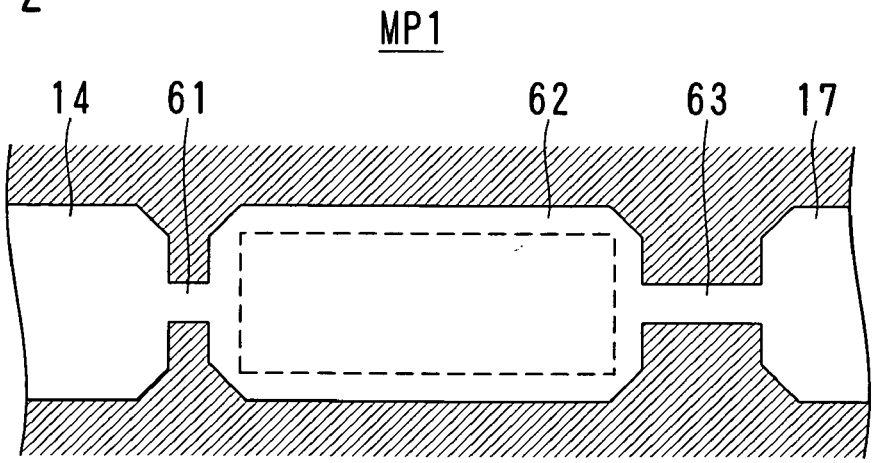
FIG. 2 is a plan view of a micropump shown in FIG. 1.
Figure 3:
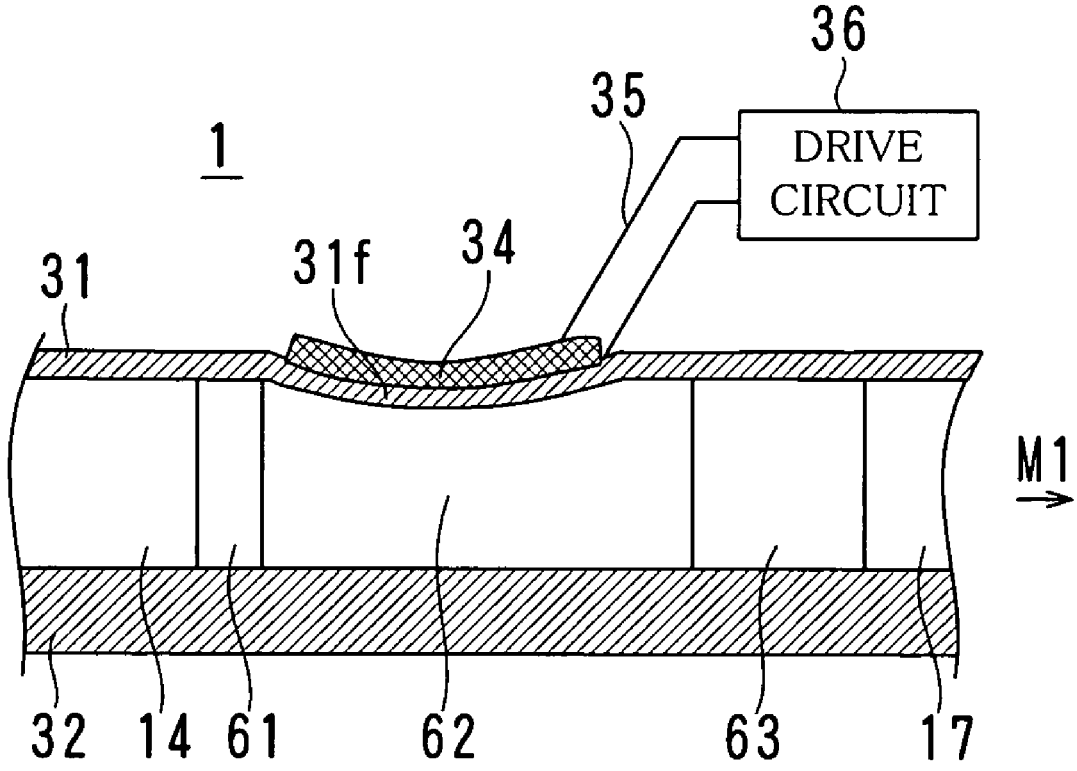
FIG. 3 is a front sectional view of a micropump.
Figure 4A:
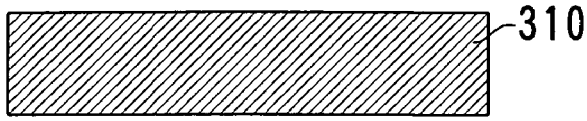
FIGS. 4A-4H show an example of a manufacturing process of a micropump.
Figure 4B:
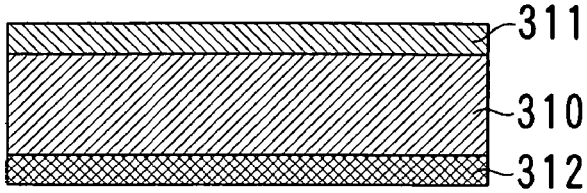
Figure 4C:
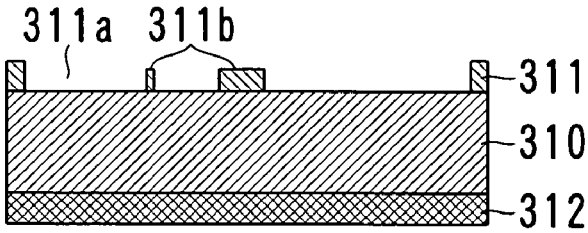
Figure 4D:
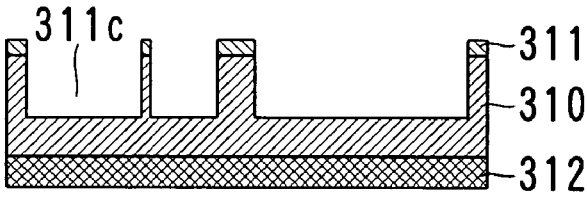
Figure 4E:
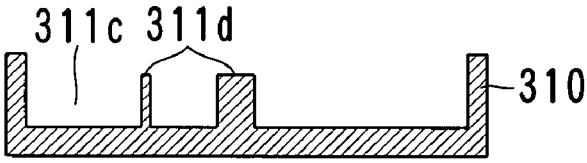
Figure 4F:
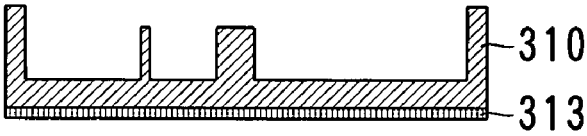
Figure 4G:
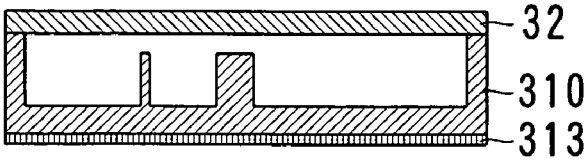
Figure 4H:
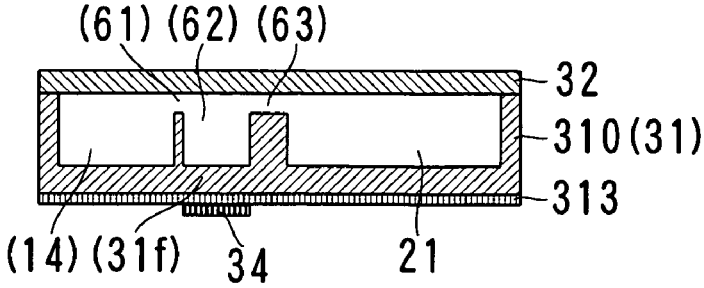
Figure 5:
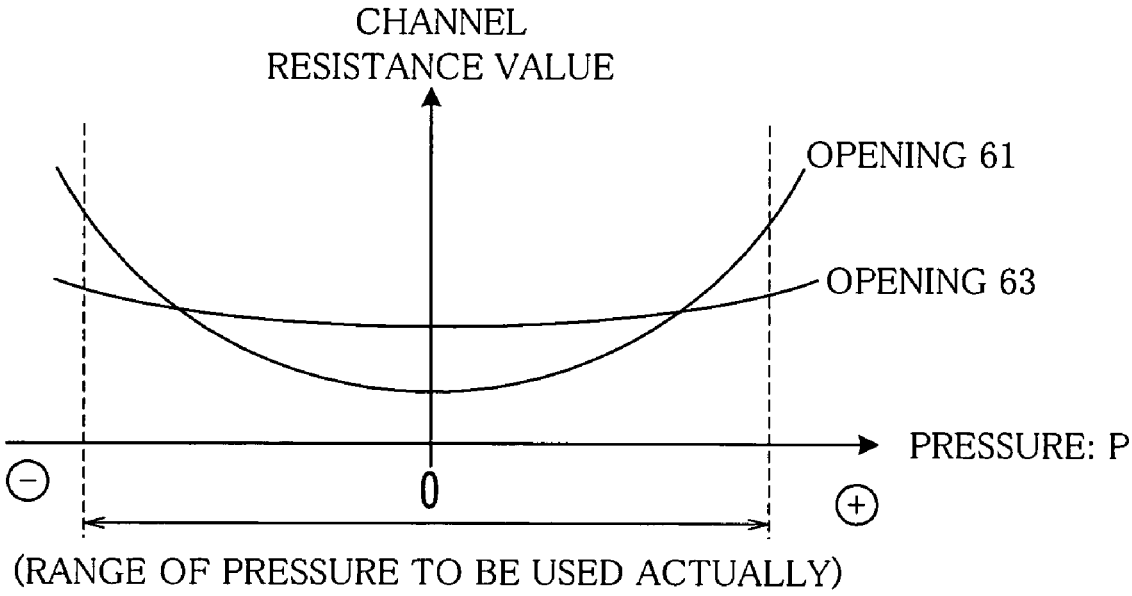
FIG. 5 is a diagram showing an example of channel resistance characteristics of openings of a micropump.
Figure 6A:
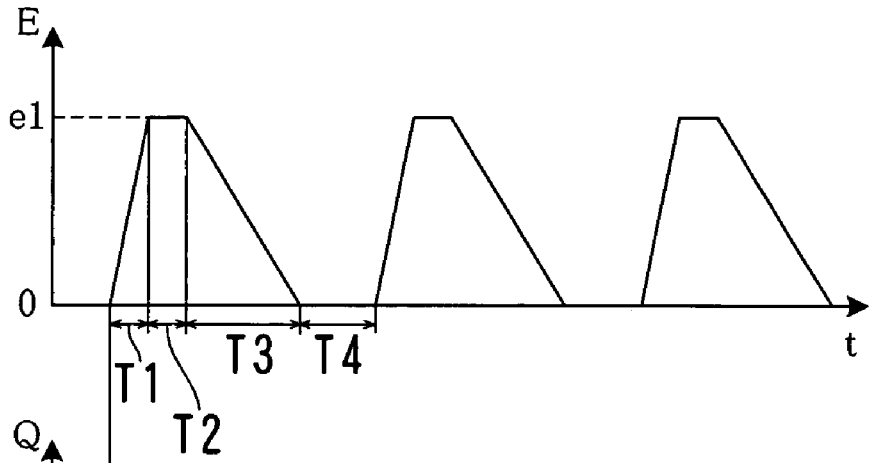
FIGS. 6A and 6B show an example of waveforms of a drive voltage of a piezoelectric element.
Figure 6B:
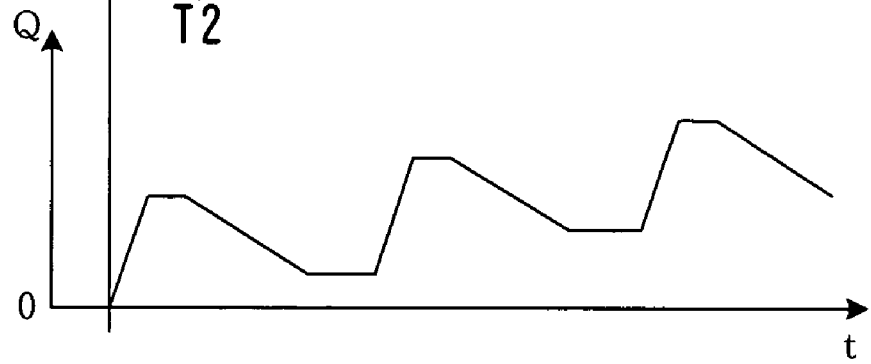
Figure 7A:
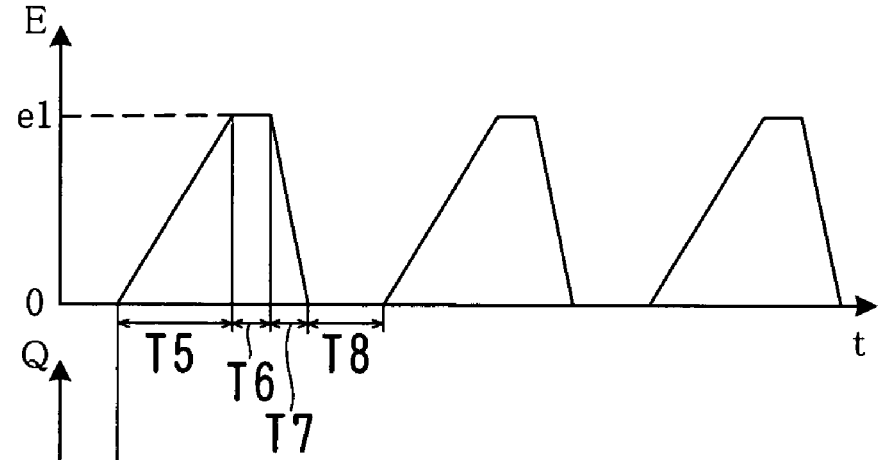
FIGS. 7A and 7B show an example of waveforms of a drive voltage of a piezoelectric element.
Figure 7B:
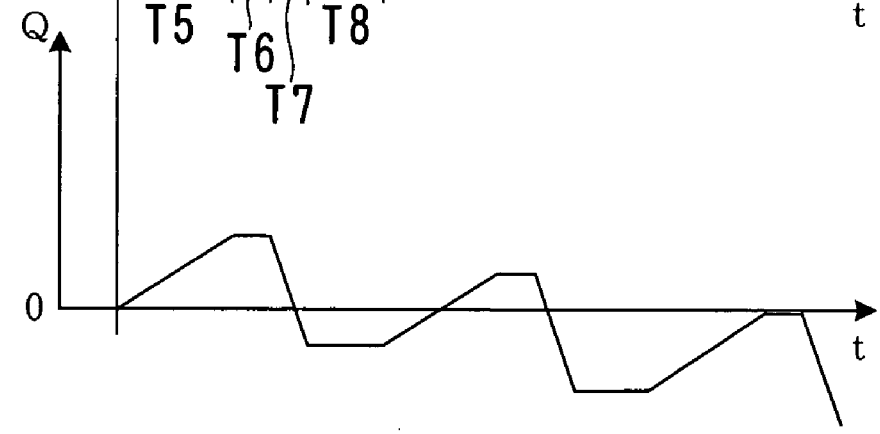

FIG. 1 is a plan view schematically showing a structure of a microfluidic system 1 that is a first embodiment of a mixing device in the present invention, FIG. 2 is a plan view of a micropump MP1 shown in FIG. 1, FIG. 3 is a front sectional view of the micropump MP1, FIGS. 4A-4H show an example of a manufacturing process of the micropump MP1, FIG. 5 is a diagram showing an example of channel resistance characteristics of openings of the micropump MP1, and FIGS. 6A and 6B as well as FIGS. 7A and 7B show examples of waveforms of a drive voltage of a piezoelectric element respectively.

Referring to FIG. 1, the microfluidic system 1 is structured on a silicon substrate 31 in the form of a microchip. The microfluidic system 1 is so structured that a liquid LA delivered by the middle micropump MP1 and a liquid LB delivered by each of micropumps MP2 and MP3 that are provided on the both sides of the micropump MP1 flow together at a confluence GT, and thereby to mix together for being discharged from a port (a liquid outlet) 25.

More particularly, the microfluidic system 1 includes ports (liquid inlets) 11-13, channels 14-16, the micropumps MP1-MP3, channels 17-19, narrow channels 20-23, a channel 24 and the port 25.

Necessary liquids are supplied to the ports 11-13 from other appropriate channels or reservoirs. The liquids pass through the respective channels 14, 15 and 16 to be delivered to the respective channels 17, 18 and 19 by the respective micropumps MP1, MP2 and MP3, then to be delivered to the respective narrow channels 20, 21 and 22 that have a width smaller than that of each of the channels 17, 18 and 19.

A common space area occupied by ends of the three narrow channels 20-22 is the confluence GT. Two of the narrow channels, i.e., the channels 21 and 22 provided on both sides of the narrow channel 20 have a symmetrical shape with respect to the middle narrow channel 20. The channels 21 and 22 are formed so as to join together symmetrically from the both sides of the narrow channel 20. The narrow channel 23 that extends from the confluence GT to the downstream is formed as an extension of the middle narrow channel 20.

Accordingly, the liquids delivered to the narrow channels 20-22 flow together at the confluence GT that is an entrance of the narrow channel 2-3, so that the liquids pass through the channel 24 to be discharged from the port 25 to other appropriate channels or reservoirs.

Next, a description is provided of the micropumps MP1-MP3. Since the three micropumps MP1-MP3 are equal to one another in principle of operation and structure, one of the micropumps, i.e., the micropump MP1 is described.

Referring to FIGS. 2 and 3, the micropump MP1 includes a chamber 62 functioning as a pump chamber and openings 61 and 63 that are formed at an inlet and an outlet of the chamber 62 respectively. The openings 61 and 63 connect to the channels 14 and 17 respectively. The openings 61 and 63 have width dimensions or effective sectional areas smaller than that of the channel 14 or the channel 17, and the openings 61 and 63 differ from each other in effective length. The differences in shape and dimensions allow the micropump MP1 to operate as a micropump. The details are described later.

With reference to FIG. 3, the micropump MP1 is fabricated as follows. A photolithography process is used to form grooves or cavities on the silicon substrate 31, the grooves or cavities eventually structuring the chamber 62, the openings 61 and 63, the channels 14 and 17 or others. Then, a glass substrate 32 as a bottom plate or a top plate is bonded to a lower surface or an upper surface of the silicon substrate 31.

For example, a silicon substrate 310 is prepared as shown in FIG. 4A. A silicon wafer having a thickness of 200 μm, for example, is used as the silicon substrate 310. Then, oxide films 311 and 312 are formed on the upper and lower surfaces of the silicon substrate 310 respectively, as shown in FIG. 4B. Each of the oxide films 311 and 312 is coated by thermal oxidation so as to have a thickness of 1.7 μm. After that, the upper surface is coated with a resist, exposure and development of a predetermined mask pattern is performed, and the oxide film 311 is etched. Then, the resist on the upper surface is peeled off, and subsequently, coating of a resist, exposure, development and etching are performed again. In this way, portions 311*a* where the oxide film 311 is completely removed and portions 311*b* where the oxide film 311 is partly removed in the thickness direction are formed as shown in FIG. 4C. In the resist coating process, for example, a resist such as OFPR800 is used to perform spin coating with a spin coater. The resist film has a thickness of, for example, 1 μm. An aligner is employed for exposure and a developer is used for development. For instance, RIE is used for etching of the oxide film. A stripper such as a mixture of sulfuric acid and hydrogen peroxide is used in order to separate the resist.

Next, before completing silicon etching of the upper surface, the oxide film 311 is completely removed by the etching process. Then, silicon etching is performed again to form portions 311*c* where the silicon substrate 310 is etched by 170 μm in depth and portions 311*d* where the silicon substrate 310 is etched by 250 μm in depth, as shown in FIGS. 4D and 4E. For the silicon etching, for example, Inductively Coupled Plasma (ICP) is used.

As shown in FIG. 4E, BHF is used, for example, to remove the oxide film 311 on the upper surface completely. Then, an electrode film 313 such as an ITO film is formed on the lower surface of the silicon substrate 310 as shown in FIG. 4F. Subsequently, a glass plate 32 is attached to the upper surface of the silicon substrate 310 as shown in FIG. 4G. For the attachment of the glass plate 32, anodic bonding is performed under the condition of 1200 V and 400° C. Lastly, as shown in FIG. 4H, a piezoelectric element 34 such as PZT (lead zirconate titanate) ceramics is adhered to a portion of a diaphragm of the chamber 17 for attachment.

Note that, in FIG. 4H, reference numerals in parentheses show portions corresponding to the portions denoted by the same reference numerals in FIG. 3. Referring to FIG. 3, the openings 61 and 63 are formed by reducing widths of grooves (the vertical direction with respect to the paper surface) compared to the channels 14 and 17 to serve as openings. Referring to FIG. 4H, the openings 61 and 63 are formed by reducing depths of grooves (the vertical direction in a plan view) compared to the channels 14 and 17 to serve as openings. Further, note that the upper side and the lower side shown in FIG. 3 are turned upside down in FIG. 4H.

The micropump MP1 can be fabricated in the method described above. Instead, it is also possible to fabricate the micropump MP1 by conventionally known methods or other methods, or by the use of other materials.

A drive circuit 36 is used to apply a voltage having a waveform shown in FIG. 6A or FIG. 7A to the piezoelectric elements 34, so that a diaphragm 31*f* that is a silicon thin film and the piezoelectric elements 34 perform flexion deformity in unimorph mode. The flexion deformity is used for increase or decrease of the volume of the chamber 62.

To cite instances of dimensions, with reference to FIG. 1, each of the channels 14-16, each of the channels 17-19 and the channel 24 has, for example, a width of 150 μm and a depth of 170 μm. Each of the narrow channels 20-23 has, for example, a width of 30 μm, a depth of 170 μm and a length of 500 μm. Additionally, the microchip has outside dimensions of 20 mm×40 mm×0.5 mm. These dimensions and shapes are one example and other various dimensions and shapes can be adopted.

The openings 61 and 63 have effective sectional areas smaller than those of the channels 14 and 17. The opening 63 is so set that the opening 63 has a lower rate of change in channel resistance when pressure inside the chamber 62 is raised or lowered, compared to the opening 61.

More specifically, as shown in FIG. 5, the opening 61 has low channel resistance when the differential pressure between the both ends thereof is close to zero. As the differential pressure in the opening 61 increases, the channel resistance thereof increases. Stated differently, pressure dependence is large. Compared to the case of the opening 61, the opening 63 has higher channel resistance when the differential pressure is close to zero. However, the opening 63 has little pressure dependence. Even if the differential pressure in the opening 63 increases, the channel resistance thereof does not change significantly. When the differential pressure is large, the opening 63 has channel resistance lower than the opening 61 has.

The characteristics of channel resistance mentioned above can be obtained by any of the following: 1. Bringing a liquid flowing through a channel to be any one of laminar flow and turbulent flow depending on the magnitude of the differential pressure. 2. Bringing the liquid to be laminar flow constantly regardless of the differential pressure. More particularly, for example, the former can be realized by providing the opening 61 in the form of an orifice-like opening having a short channel length, while the latter can be realized by providing the opening 63 in the form of a nozzle-like opening having a long channel length. In this way, the characteristics of channel resistance discussed above can be realized.

The channel resistance characteristics of the opening 61 and the opening 63 are used to produce pressure in the chamber 62 and a rate of change in pressure is controlled, so that a pumping action in a discharge process and a suction process respectively, such as discharging or sucking more fluids to/from either one of the openings 61 and 63 that has lower channel resistance can be realized.

More specifically, the pressure in the chamber 62 is raised and the rate of change in pressure is made large, resulting in the high differential pressure. Accordingly, the channel resistance of the opening 61 is higher than that of the opening 63, so that most fluids within the chamber 62 are discharged from the opening 63 (discharge process). The pressure in the chamber 62 is lowered and the rate of change in pressure is made small, which keeps the differential pressure low. Accordingly, the channel resistance of the opening 61 is lower than that of the opening 63, so that more liquids flow from the opening 61 into the chamber 62 (suction process).

To the contrary, the pressure in the chamber 62 is raised and the rate of change in pressure is made small, which keeps the differential pressure low. Accordingly, the channel resistance of the opening 61 is lower than that of the opening 63, so that more fluids in the chamber 62 are discharged from the opening 61 (discharge process). The pressure in the chamber 62 is lowered and the rate of change in pressure is made large, resulting in the high differential pressure. Accordingly, the channel resistance of the opening 61 is higher than that of the opening 63, so that more fluids flow from the opening 63 into the chamber 62 (suction process).

The drive voltage supplied to the piezoelectric element 34 is controlled and the amount and timing of deformation of the diaphragm are controlled, which realizes pressure control of the chamber 62 mentioned above. For example, a drive voltage having a waveform shown in FIG. 6A is applied to the piezoelectric element 34, leading to discharge to the channel 17 side. A drive voltage having a waveform shown in FIG. 7A is applied to the piezoelectric element 34, leading to discharge to the channel 14 side.

Referring to FIGS. 6A and 6B as well as FIGS. 7A and 7B, a maximum voltage e1 to be applied to the piezoelectric element 34 ranges approximately from several volts to several tens of volts and is about 100 volts at the maximum. Time T1 and T7 are on the order of 20 μs, time T2 and T6 are from approximately 0 to several microseconds and time T3 and T5 are about 60 μs. Time T4 and T8 may be zero. Frequency of the drive voltage is approximately 11 KHz. With drive voltages shown in FIGS. 6A and 7A, the channel 17 provides flow rates, for example, illustrated in FIGS. 6B and 7B. Flow rate curves in FIGS. 6B and 7B schematically show flow rates obtained by a pumping action. In practice, inertial oscillation of a fluid is added to the flow rate curves. Accordingly, curves in which oscillation components are added to the flow rate curves shown in FIGS. 6B and 7B show actual flow rates obtained by an actual pumping action.

Each of the openings 61 and 63 in the first embodiment is structured by a single opening. Instead, a group of openings can be used in which plural openings are arranged in parallel. The use of the group enables pressure dependence to be further lowered. Accordingly, when the group of openings is substituted for the opening, especially for the opening 63, the flow rate is increased and the flow rate efficiency is improved.

Next, descriptions are provided as to how liquids interflow and mix in the microfluidic system 1 and of a driving method of the piezoelectric element 34 at the time of the interflow and the mix.

Figure 8:
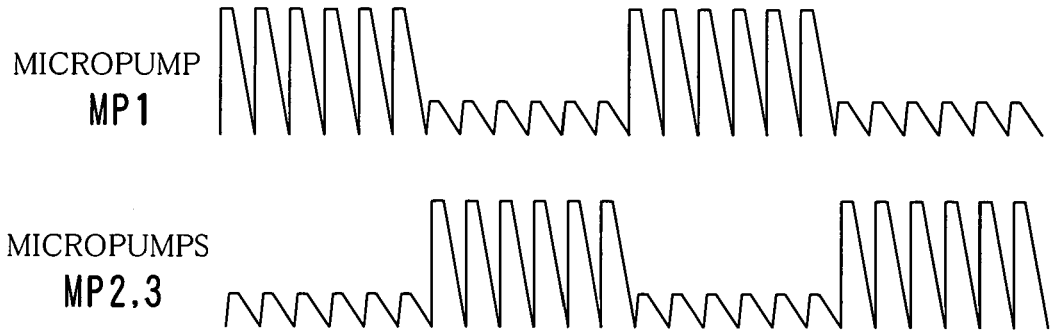
FIG. 8 shows an example of waveforms of a drive voltage according to the first embodiment.
Figure 9:
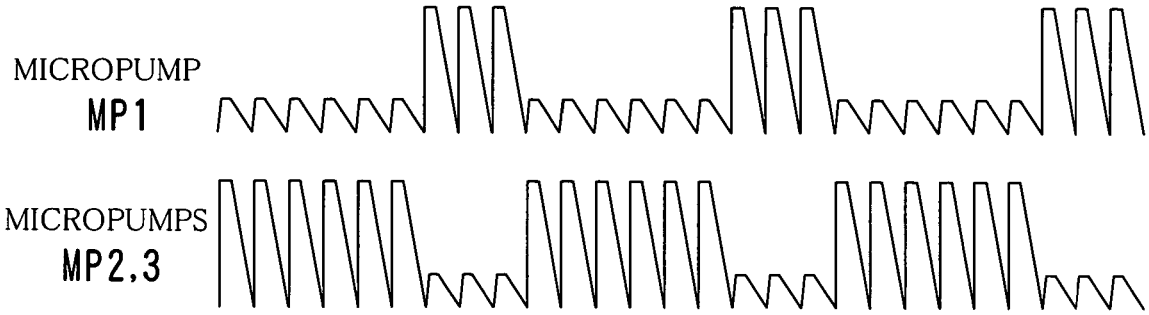
FIG. 9 shows another example of waveforms of a drive voltage.
Figure 10:
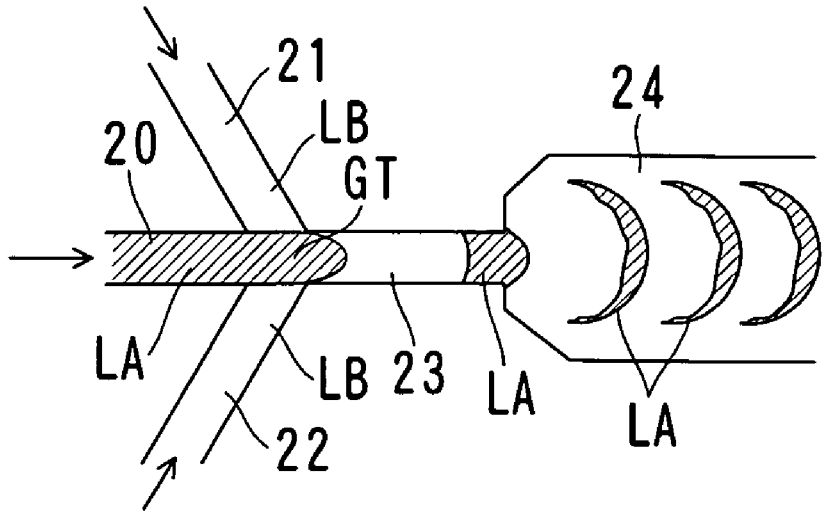
FIG. 10 shows how liquids flow by application of the drive voltage shown in FIG. 8.
Figure 11:
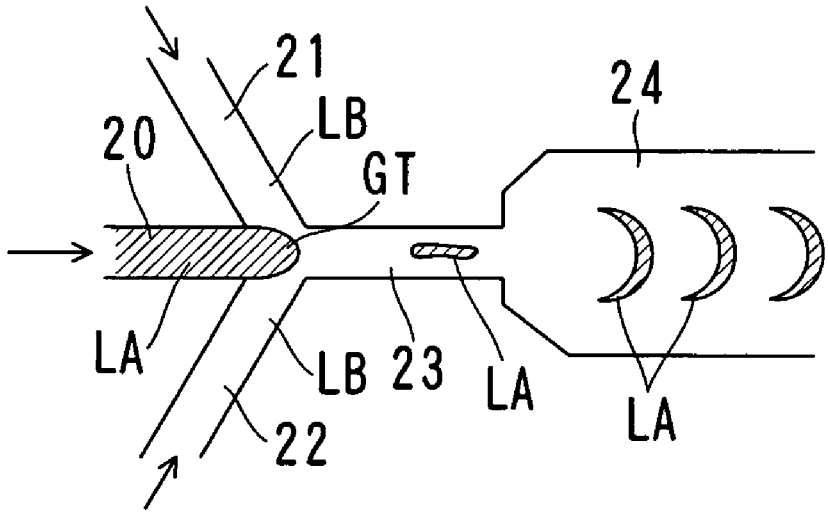
FIG. 11 shows how liquids flow by application of another drive voltage.
Figure 12:
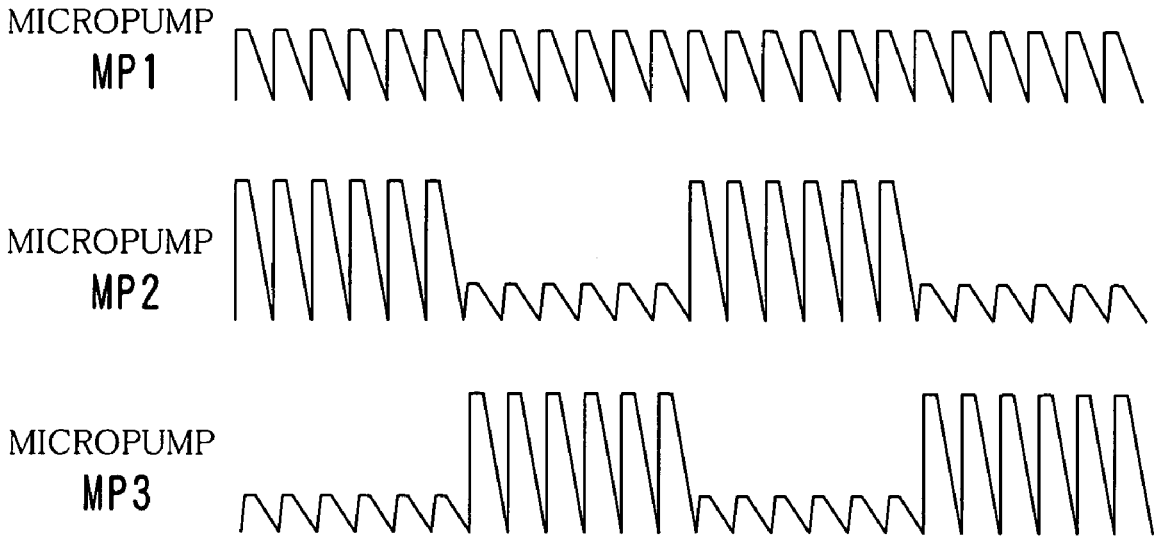
FIG. 12 shows another example of waveforms of a drive voltage.
Figure 13:
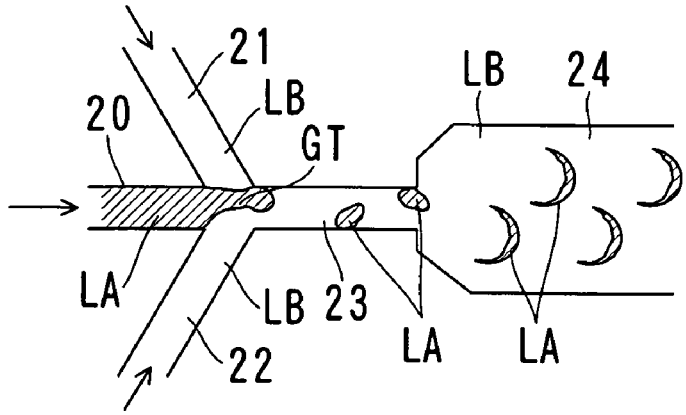
FIG. 13 shows how liquids flow by application of the drive voltage shown in FIG. 12.
Figure 14:
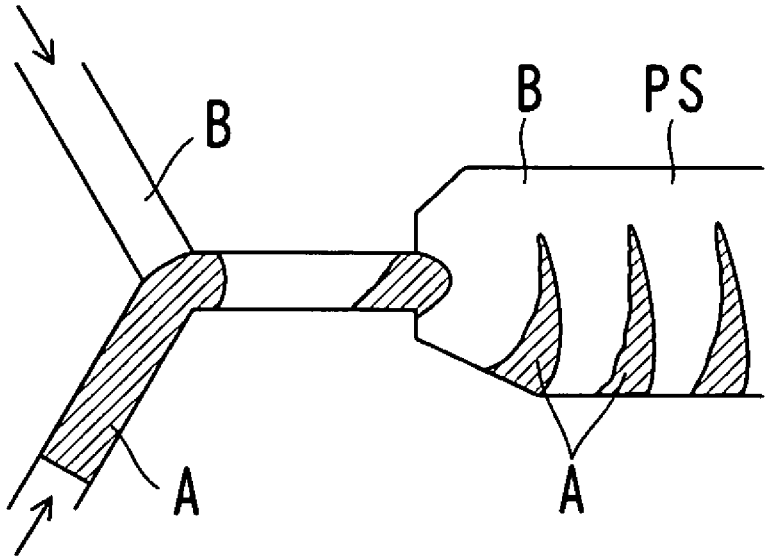
FIG. 14 PRIOR ART
FIG. 14 shows how liquids flow in a conventional mixing method.
Figure 15:
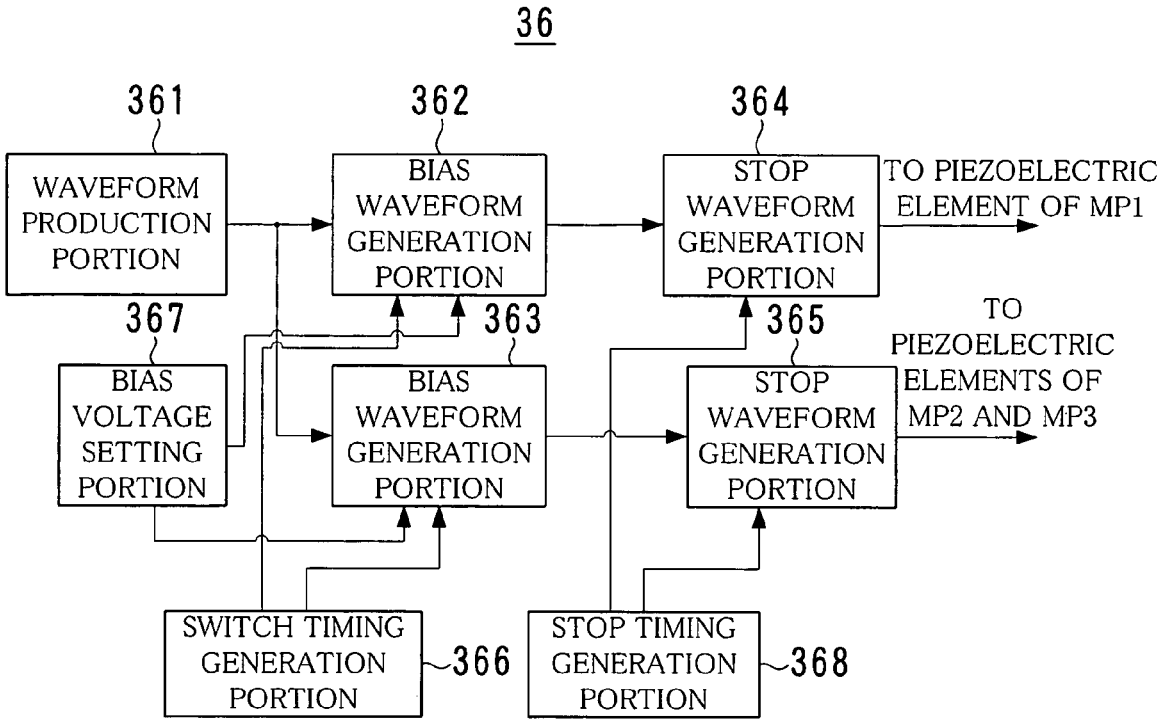
FIG. 15 is a block diagram showing an example of a structure of a drive circuit.

FIG. 8 shows an example of waveforms of a drive voltage in the first embodiment, FIG. 9 shows another example of waveforms of a drive voltage, FIG. 10 shows how liquids flow by application of the drive voltage shown in FIG. 8, FIG. 11 shows how liquids flow by application of another drive voltage, FIG. 12 shows another example of waveforms of a drive voltage, FIG. 13 shows how liquids flow by application of the drive voltage shown in FIG. 12, FIG. 14 shows how liquids flow in a conventional mixing method and FIG. 15 is a block diagram showing an example of a structure of the drive circuit 36.

In the first embodiment, the liquid LA is supplied to the middle port 11, while a liquid LB is supplied to each of the two ports 12 and 13 provided on the both sides of the middle port 11, i.e., the same liquid LB is supplied to the ports 12 and 13. The middle micropump MP1 is operable to deliver the liquid LA that is fed to the narrow channel 20. The two micropumps MP2 and MP3 provided on the both sides of the micropump MP1 are operable to deliver the liquid LB that is fed to the narrow channels 21 and 22 respectively. These two kinds of liquids LA and LB interflow at the confluence GT. At the time of delivery of the liquids, the two kinds of liquids LA and LB are intermittently fed to the confluence GT one after the other, instead of being fed thereto continuously.

More specifically, as shown in FIGS. 8 and 9, while the middle micropump MP1 is driven to deliver the liquid LA, none of the other micropumps MP2 and MP3 is driven. While the micropumps MP2 and MP3 are driven to deliver the liquid LB, no middle micropump MP1 is driven. As a result, the two kinds of liquids LA and LB are alternately fed to the confluence GT in an intermittent manner.

Under this situation, when the micropumps MP2 and MP3 are not driven at all and are caused to stop during driving the micropump MP1 to deliver the liquid LA, the liquid LA is transported from the confluence GT to the narrow channel 23 that is positioned at the downstream thereof. Additionally, there is a possibility that the liquid LA flows into the narrow channels 21 and 22 located at the downstream of the undriven micropumps MP2 and MP3 are and the liquid LB flows backward. The amount of the backflow reaches approximately 20-30% of the amount of liquid transport in some cases.

Accordingly, when such a method is used for mixing, the mixed liquid of the liquid LA flowing backward and the liquid LB to be transported subsequently is transported to the confluence GT. In addition, 20-30% of the mixed liquid further flows backward to the narrow channel 20 that is for the other liquid LA. As a result, the use of the method discussed above for mixing makes it difficult to obtain a precise mixing ratio.

In order to avoid such a problem, in the first embodiment, as shown in FIG. 8, a micro drive voltage (drive pulse) is applied to the micropump(s) MP that does not operate for liquid transport, so that the micropump(s) MP operates slightly.

More particularly, referring to FIG. 8, while the middle micropump MP1 is driven to deliver the liquid LA, a micro drive voltage as a bias is applied to each of the other micropumps MP2 and MP3. While the micropumps MP2 and MP3 are driven to deliver the liquid LB, a micro drive voltage as a bias is applied to the middle micropump MP1.

Such control provides a balance between pressure of liquid that is not transported and pressure of backflow of a liquid that is delivered by driving the micropump(s) MP. As a result, no liquids flow backward and all the delivered liquids are fed to the narrow channel 23 on the downstream side.

Accordingly, it is possible to precisely obtain a mixing ratio of liquids that is equal to a desired target ratio. In addition, since no liquids flow backward and all the liquids are transported to the narrow channel 23 on the downstream side, the flow rate increases as a whole, ensuring that the flow rate efficiency is improved.

In particular, when the liquids LA and LB have a viscosity of 1 cps respectively, for example, a drive voltage of 50 V is applied for delivery of the liquid(s) while a micro drive voltage of 20 V is applied to the micropump(s) that is operated slightly.

Though frequency of the drive voltage is approximately 11 KHz as described above, timing when the micropumps are switched so as to be driven alternately and intermittently can be selected. For example, in the case of switching so as to provide frequency of 50 Hz for switching ON/OFF of drive of the micropumps MP and a duty ratio of 1:1, i.e., in the case of switching drive of the micropump MP1 and drive of the micropumps MP2 and MP3 for each 10 ms, a drive voltage that includes a group of pulses of 110 pulse is applied to the piezoelectric element 34 of each of the micropumps MP at one time. In such a case, each of the liquids LA and LB is alternately transported by each of the micropumps MP1, MP2 and MP3 to the confluence GT in increments of 2.0 nl. On this occasion, since the liquid LB is transported by the two micropumps MP2 and MP3, approximately 4.0 nl of the liquid LB is transported to the confluence GT at one time. Accordingly, a mixing ratio of the liquid LA and the liquid LB becomes 1:2 in this case.

The magnitude of the micro drive voltage as a bias varies according to a kind of pump, a type of liquid, viscosity of liquid, temperature, a width of channel and a degree of load determined by a length of liquid. Accordingly, liquid transport may be actually performed under these various conditions as experiments for determining the magnitude of the micro drive voltage.

The change of duty ratio provides various mixing ratios. When the duty ratio is 1:1 as shown in FIG. 8, for example, the mixing ratio of the liquid LA and the liquid LB becomes 1:2 as mentioned above. When the duty ratio is 1:2 as shown in FIG. 9, for example, approximately 1.0 nl of the liquid LA is transported to the confluence GT at one time and, for example, approximately 4.0 nl of the liquid LB is transported thereto at one time, in an alternate manner, so that the mixing ratio of the liquid LA and the liquid LB becomes 1:4. Further, when the duty ratio is 1:0.5, 1:0.8 or 1:10, the mixing ratio of the liquid LA and the liquid LB becomes 1:1, 1:1.6 or 1:20, respectively (not shown).

In the first embodiment, of the two kinds of liquids, the liquid LA that has a low mixing rate is transported from the middle narrow channel 20 to the confluence GT and the liquid LB that has a high mixing rate is transported from each of the two narrow channels 21 and 22 to the confluence GT. Accordingly, average amount of liquid transport using the micropump MP1 is controlled so as to be smaller than average amount of the total liquid transport using the two micropumps MP2 and MP3. In addition, as understood from the foregoing description, the same amount of liquid LB is transported from each of the two narrow channels 21 and 22 to the confluence GT and the liquid LB is transported from both the narrow channels 21 and 22 to the confluence GT in such a manner as to flow together symmetrically with respect to the narrow channel 20.

Concerning the liquid LA that has a low mixing rate, amount of liquid transport using the micropump MP1 in an intermittent manner at one time is controlled so as to be greater than a volume VK of a space of the confluence GT.

In other words, as shown in FIG. 10, in the case of delivery of the liquid LA to the confluence GT, control is so made that the space of the confluence GT is filled with amount of liquid transport of the liquid LA at one time, for even a moment. Thereby, the liquid LA and the liquid LB are transported with each forming one piece alternately. This provides alternate laminar streams of the two liquids, so that mixing is performed rapidly and the two liquids are mixed uniformly in a short time.

When amount of liquid transport of the liquid LA at one time corresponds to the volume VK of the space of the confluence GT or less, as shown in FIG. 11, the liquid LA tends to concentrate in the central part of the channel 24 without diffusing therein sufficiently. In practice, an effect of rapid mixing can be produced sufficiently even in the state shown in FIG. 11. However, the state shown in FIG. 10 is preferable for uniform mixing at higher speeds.

To the contrary, when amount of liquid transport of the liquid LA at one time is excessive, a thickness of alternate laminar streams of the liquids becomes excessively thick at the downstream, causing the mixing speed to drop significantly.

As discussed above, the liquid LA that has a low mixing rate has a suitable value of amount of liquid transport at one time. The suitable value is approximately one to five times the volume of the space of the confluence GT.

The two liquids LA and LB that are alternately delivered to the confluence GT are formed, as shown in FIGS. 10 and 11, so as to be in the form of lamina along the flow direction in the channel 24. The thickness of the lamina becomes, for example, approximately 10 μm. Voluntary diffusion occurs so that the two liquids LA and LB are mixed. When a channel has a thickness of 100 μm, for example, assuming that diffusion and mixing are performed in the channel width direction like the conventional way, the diffusion distance is 50 μm. In the case of the present embodiment, however, under such a condition, the diffusion distance is 5 μm that is a half of the lamina thickness and the diffusion time is a hundredth compared to the conventional case. In addition, since the channel width is increased significantly, an effect of turbulent flow due to the diffusion can be obtained, leading to the further promotion of mixing.

Thus, the present embodiment enables rapid mixing in a short time. Since each of the narrow channels 20-23 may be short, there is no possibility that increase of channel resistance makes the liquid transport control difficult, preventing the deterioration of controllability.

As described above, when frequency for switching ON/OFF of drive of the micropumps MP is set to approximately 50 Hz or less, liquid transport per once forms a laminar stream having a length of two to five times the width of the narrow channel 23, so that mixing can be performed stably.

In order to change a mixing ratio of the two liquids LA and LB, it is possible to control a voltage ratio of drive voltages supplied to the respective piezoelectric elements 34 of the micropumps MP1-MP3, instead of changing the duty ratio as mentioned above. In such a case, a drive voltage to be applied to the piezoelectric element(s) 34 of the micropump(s) MP that is not operable to transport liquid, i.e., a micro drive voltage is required to be set in accordance with a drive voltage of the piezoelectric element(s) 34 of the micropump(s) MP that is driven for liquid transport. The gradual change of the duty ratio and the voltage ratio of the drive voltages with time allows for change of the mixing ratio along the flow direction of the channel. Such control can provide a concentration gradient or a PH gradient, for example.

In the example described above, the same drive voltage is used to drive the micropumps MP2 and MP3. However, it is not necessarily to drive the micropumps MP2 and MP3 using the same drive voltage. As long as, in the channel 24 after interflow of the two liquids, the alternate laminar streams of the two liquids are formed in the flow direction, switching timing of drive or a drive voltage can be different between the two micropumps MP2 and MP3. In such an occasion, even if each of the alternate laminar streams is not symmetrical with respect to the flow direction, it is sufficient that each of the alternate laminar streams is balanced on the sides thereof as a whole in the channel 24 after interflow.

Referring to FIG. 12, for example, the middle micropump MP1 is driven by a drive voltage with no pulse, i.e., a drive voltage having a constant drive waveform with a duty ratio of 1, while the other two micropumps MP2 and MP3 are driven by a drive voltage having a pulse waveform with pulses switching alternately.

Under this drive condition, as shown in FIG. 13, the liquid LA that has a low mixing rate is continuously transported from the middle narrow channel 20, while the liquid LB that has a high mixing rate is transported alternately on the time scale from each of the narrow channels 21 and 22. Here, it is preferable that the volume (amount of liquid transport) of the liquid LB delivered from the narrow channels 21 and 22 at one time is a little more than the volume of the space of the confluence GT.

Under such a drive, the liquid LA that has a low mixing rate is divided every time when the liquid LB is delivered from the narrow channels 21 and 22 alternately, so that the liquid LA is transported to the downstream with being on the either left side or right side of the channel every other laminar stream. Thereby, in the downstream of the confluence GT, though the liquid LB is unevenly distributed on the either left side or right side microscopically, the liquid LB is not confined to the either left side or right side macroscopically and approximately uniform distribution can be obtained. Thus, the drive allows for uniform diffusion and mixing at high speed.

Note that, in the above-mentioned example, the liquid LA to be delivered from the middle narrow channel 20 to the confluence GT can be transported intermittently as shown in FIGS. 8 and 9.

Next, advantages of the foregoing microfluidic system 1 are described in comparison to conventional cases.

As shown in FIG. 14, when two channels are formed in a Y-configuration for mixing two liquids, in some cases, the two liquids A and B lean to the either left side or right side of a channel PS in an asymmetric fashion due to the characteristic in which a liquid against a wall is hard to flow. This phenomenon occurs notably in the case where a switching cycle of a drive pulse is short (amount of liquid transport at one time is small) or in the case where a micro voltage for preventing backflow is excessively high and a liquid that should not be transported also flows into the confluence GT. When this phenomenon occurs, especially when the mixing ratio is far from 1:1, unevenness and variation in mixing tend to be large.

In contrast, the microfluidic system 1 according to the embodiment described above has a structure in which a liquid having a low mixing rate is delivered from the middle narrow channel 20 and the other liquid is delivered from each of the channels located on the both sides of the middle narrow channel 20 for interflowing symmetrically. Accordingly, unevenness in concentration does not occur on the left and right sides of the channel.

Further, since the liquid having a low mixing rate is diffused from the central part of the channel, time required for diffusing the liquid in the entire channel is short compared to the case where a liquid is diffused from the wall side of the channel. Additionally, since the liquid having a low mixing rate is present at a position appropriate for dispersion, the liquid is easy to diffuse in a short time without staying partly. Thus, the microfluidic system 1 according to the present embodiment enables two liquids to mix together at high speed and at a precise mixing ratio compared to conventional cases. In addition, unevenness of concentration can be minimized in the channel width direction.

Further, another reason for delivering the liquid having a low mixing rate from the central part of the channel is that variation in flow rate occurs easily in the vicinity of channel walls. In other words, variation in flow rate (amount of liquid transport) of the liquid having a low mixing rate greatly influences variation in actual mixing ratio, compared to the case of variation in flow rate of the liquid having a high mixing rate. So, the liquid having a low mixing rate preferably avoids the vicinity of the channel walls.

When a mixing rate is 1:1 or not so far from 1:1, in other words, when a mixing rate is approximately 1:2 or less, the liquid having a low mixing rate is not necessarily delivered from the middle channel.

Even if a liquid that flows from the middle channel to join another liquid has amount of liquid transport larger than another liquid has, the liquids do not lean to the channel width direction as shown in FIG. 14, provided that alternate laminar streams in the flow direction are formed as shown in FIG. 10. Accordingly, the effects described above can be provided to some extent.

The number of channels joining together at the confluence GT is not limited to three as mentioned above and can be four or more. In such a case, a structure is possible in which channels filled with the liquid LA or the liquid LB join together alternately. Alternatively, another structure is possible in which odd numbers of channels are prepared, the liquid LA is delivered from a first middle channel, the liquid LB is delivered respectively from second channels located on both sides of the first middle channel and the liquid LC is delivered respectively from two third channels each of which is located outside the second channels.

Referring to FIG. 15, the drive circuit 36 includes, for example, a waveform production portion 361, bias waveform generation portions 362 and 363, stop waveform generation portions 364 and 365, a switch timing generation portion 366, a bias voltage setting portion 367 and a stop timing generation portion 368.

The waveform production portion 361 generates basic waveforms. The bias waveform generation portions 362 and 363 generate bias waveforms so as to provide a micro drive voltage during a predetermined period based on timing signals outputted from the switch timing generation portion 366. The voltage value of each of the bias waveforms is set based on setting signals outputted from the bias voltage setting portion 367. The stop waveform generation portions 364 and 365 generate stop waveforms to provide zero of voltage value only during a predetermined stop period Ts mentioned below, based on timing signals outputted from the stop timing generation portion 368.

Figure 16:
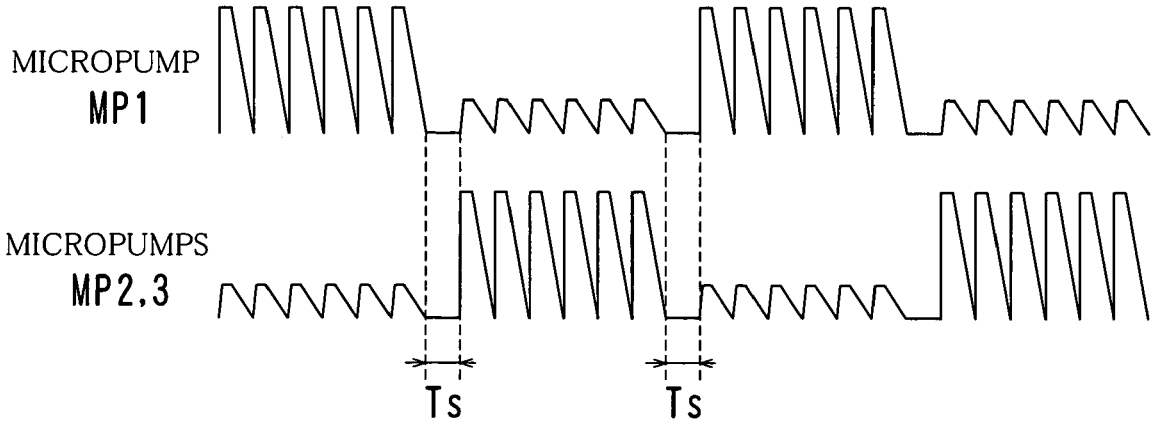
FIG. 16 shows waveforms of a drive voltage when a stop time is provided.

The stop waveform generation portions 364 and 365 output drive voltage waveforms, for example, as shown in FIG. 16, and such a drive voltage is applied to each of the piezoelectric elements 34.

Note that synchronization is made by clock signals in each of the portions of the drive circuit 36. It is possible that the CPU executes a suitable program to realize a part of the structure of the drive circuit 36. Further, contents of the structure can be varied.

Next, a description is provided of another embodiment of a driving method of the piezoelectric elements 34 in the microfluidic system 1.

FIG. 16 shows waveforms of drive voltages when a stop time is provided.

As shown in FIG. 16, a drive voltage is applied to the piezoelectric element 34 of each of the micropumps MP alternately, and a micro drive voltage is applied thereto during no application of the drive voltage. Then, a stop period Ts when no voltage is applied is provided between the application of drive voltage and the application of micro drive voltage. In this way, a stop period is provided between drive and slight operation of each of the micropumps MP. The stop period is set so as to have a length corresponding to one pulse or more. This time length corresponds to, for example, approximately 100 μs or length longer than that. The stop period is set so as to have a length corresponding to one pulse, two pulses, three pulses or others, which facilitates control.

Thus, the provision of the stop period makes it possible to control an inertial force of liquid flow when drive voltages are switched, enabling more precise control.

The length of the stop period can be different after the application of drive voltage and after the application of micro drive voltage. In addition, the stop period of either one, e.g., the stop period after the application of micro drive voltage can be omitted.

Second Embodiment

In the microfluidic system 1 of the first embodiment discussed above, the micropumps MP1-MP3 are used, the number of which is equal to the number of channels 17-19 joining together at the confluence GT. Instead, in the second embodiment, one micropump MP is used to transport a liquid LB and a channel is branched, since the channels 18 and 19 joining together transport the same liquid LB.

Figure 17:
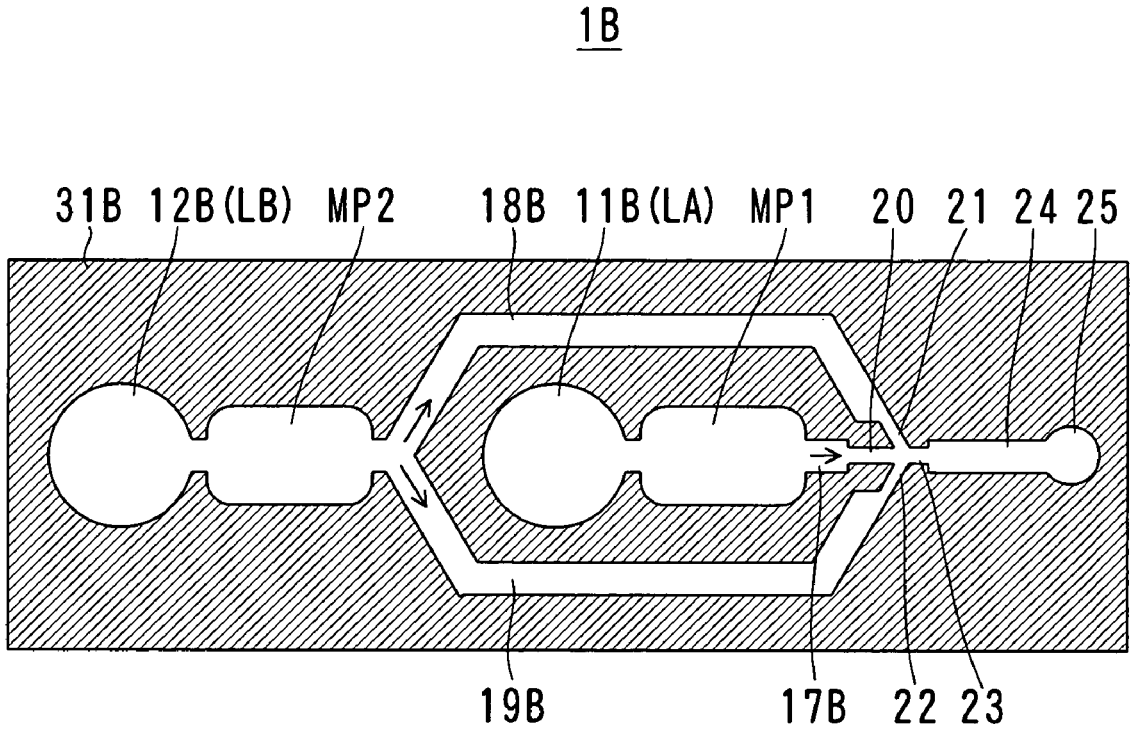
FIG. 17 is a plan view showing a structure of a microfluidic system according to a second embodiment.

FIG. 17 is a plan view schematically showing a structure of a microfluidic system 1B according to the second embodiment of the present invention.

As shown in FIG. 17, the microfluidic system 1B includes ports 11B and 12B, micropumps MP1 and MP2, channels 17B, 18B and 19B, narrow channels 20-23, a channel 24 and a port 25.

A liquid LA having a low mixing rate is supplied to the port 11B, while a liquid LB having a high mixing rate is supplied to the port 12B. The liquid LA is transported to the channel 17B by the micropump MP1, then to be delivered from the narrow channel 20 to the confluence GT. The liquid LB is transported to the two channels 18B and 19B by the micropump MP2 with being divided, then to be delivered from the respective narrow channels 21 and 22 to the confluence GT.

The microfluidic system 1B operates similar to the microfluidic system 1 in the first embodiment, so that similar effects can be obtained. In addition, in the microfluidic system 1B, the small number of micropumps MP leads to the low cost and easy maintenance.

It is possible to provide reservoirs for storing each of the liquids instead of the ports 11B and 12B, which can be mentioned with respect to the first embodiment.

The two kinds of liquids LA and LB are mixed in the embodiment discussed above. Instead, a structure is possible in which three kinds of liquids LA, LB and LC are mixed. Such a modification is described below.

Figure 18:
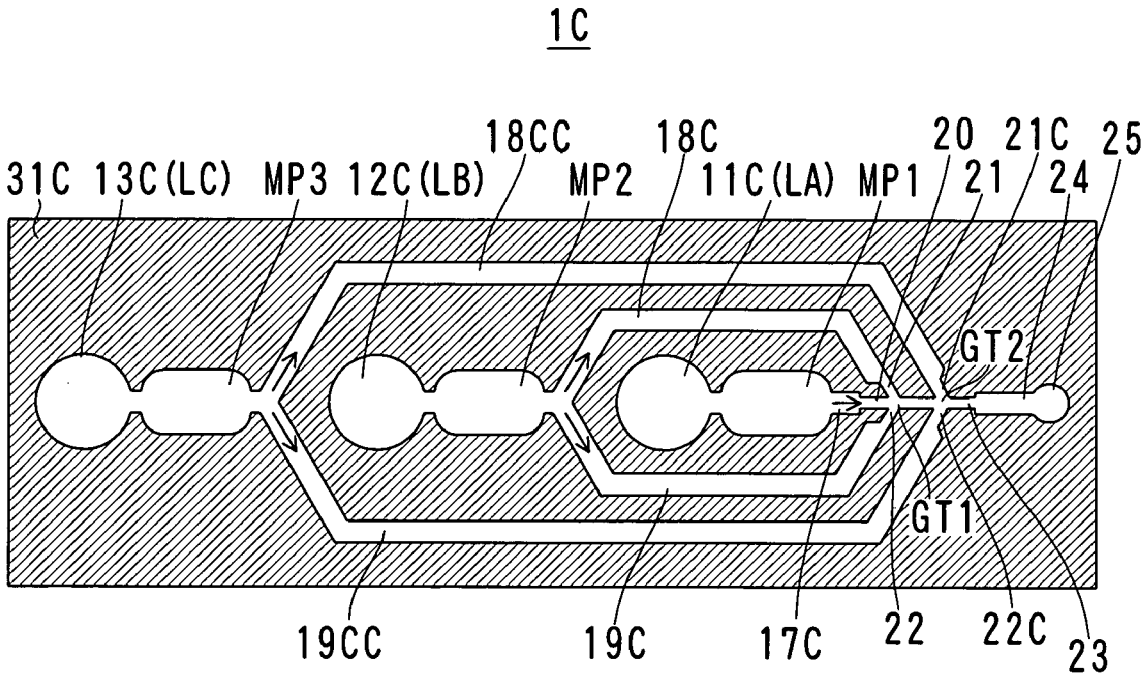
FIG. 18 is a plan view showing a modification of the microfluidic system according to the second embodiment.
Figure 19:
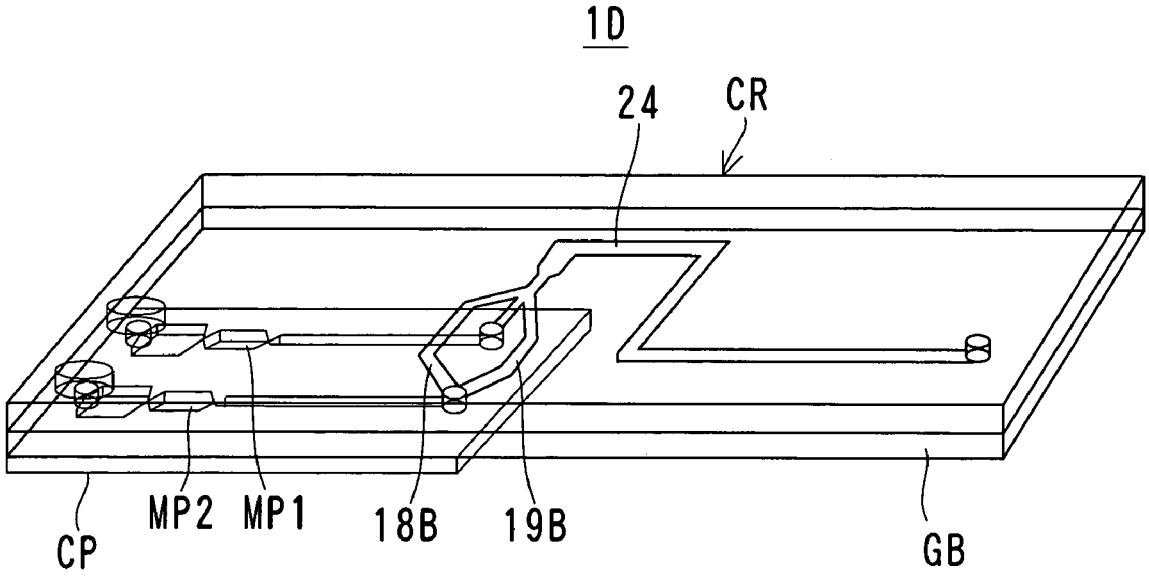
FIG. 19 is a perspective view showing an example of a microfluidic system made up of plural microchips.

FIG. 18 is a plan view schematically showing a structure of a microfluidic system 1C that is a modified example of the second embodiment, and FIG. 19 is a perspective view showing an example of a microfluidic system 1D made up of plural microchips.

Referring to FIG. 18, the microfluidic system 1C includes ports 11C, 12C and 13C, micropumps MP1-MP3, channels 17C, 18C, 19C, 18CC and 19CC, narrow channels 20-23, a channel 24 and a port 25. Two confluences GT1 and GT2 are provided in the narrow channel 23.

A liquid LA having a low mixing rate is supplied to the port 11C, while liquids LB and LC each having a high mixing rate is supplied to the ports 12C and 13C respectively. The liquid LA is transported to the channel 17C by the micropump MP1, then to be delivered from the narrow channel 20 to the confluence GT1. The liquid LB is transported to the two channels 18C and 19C by the micropump MP2 with being divided, then to be delivered from the respective narrow channels 21 and 22 to the confluence GT1. The two kinds of liquids LA and LB interflow at the confluence GT1.

The liquid LC is transported to the two channels 18CC and 19CC by the micropump MP3 with being divided, then to be delivered from the respective narrow channels 21C and 22C to the confluence GT2. The mixed liquid of the two kinds of liquids LA and LB, and the liquid LC interflow at the confluence GT2. The collected liquids LA, LB and LC are mixed with flowing through the channel 24.

The microfluidic system 1C enables three kinds of liquids to be mixed. In addition, the microfluidic system 1C operates similar to the cases of the microfluidic system 1 in the first embodiment and the microfluidic system 1B, so that similar effects can be obtained.

Further, when a mixing ratio of two kinds of liquids is far from 1:1, the microfluidic system 1C shown in FIG. 18 can be used to mix the liquid having a high mixing rate with the other liquid in twice.

More specifically, in the microfluidic system 1C, the liquid LB having a high mixing rate is supplied to the ports 12C and 13C. The liquid LB interflows at the confluences GT1 and GT2 with respect to the liquid LA that has a low mixing rate and is transported by the micropump MP1. By this method, two kinds of liquids that differ largely in mixing rate can be successfully mixed in a stable manner.

The confluences GT1 and GT2 are located at different positions in the drawing, such as the first stage and the second stage. Instead, the confluences GT1 and GT2 can be located at the same position so that liquids flow together at the same one position in one. Further, it is possible to provide reservoirs for storing each of the liquids instead of the ports 11C, 12C and 13C.

Thus, the combination of plural micropumps MP and plural channels enables plural kinds of arbitrary liquids to be mixed.

In the microfluidic systems 1B and 1C, a liquid flows from one micropump MP through two branched channels. Instead, a liquid can flow through even numbers of channels, e.g., four or six channels that are branched so as to produce a symmetrical appearance, then to flow together with respect to a middle channel (narrow channel). Alternatively, it is possible to provide odd numbers of branched channels. In such a case, a structure is possible, for example, in which liquids flow together sequentially and alternately from left side and right side with respect to the middle channel.

In the examples described above, the microfluidic system 1, 1B, or 1C is formed on one microchip. Instead, each portion can be formed on one microchip, or, each portion can be in the form of structure other than the microchip, so that the portions, i.e., the microchips or the structures other than the microchip are coupled to each other.

As shown in FIG. 19, for example, a pump chip CP where micropumps MP are formed can be connected to a channel chip CR where channels for mixing are formed through a glass plate GB in a three-dimensional manner so that a microfluidic system 1D is structured. The microfluidic system 1D is equal to the microfluidic system 1B in structure of fluid circuit.

In this example of the microfluidic system 1D, an adhesive is used to bond an upper surface of the pump chip CP to a predetermined position of a lower surface of the glass plate GB, and a lower surface of the channel chip CR is removably attached to an upper surface of the glass plate GB. Liquid inlets and liquid outlets on the pump chip CP are provided in such a manner as to correspond to liquid supply ports and inlets of liquids to be mixed of the channel chip CR through the glass plate GB.

Further, the pump chip CP and the channel chip CR can be made from various materials such as PMMA, PC, POM, glass or silicon.

This microfluidic system 1D eliminates the need for positioning the branched channels with detouring around the port 11B, the reservoirs or the micropump MP1, ensuring that the length of the branched channels 18B and 19B can be shortened.

Third Embodiment

In the embodiments discussed above, the systems are structured in which a liquid delivered from channels formed on both sides of a middle channel flow together with respect to a liquid delivered from the middle channel at the same confluence GT. It is not necessarily, however, that the liquids flow together at the same position. The liquids delivered from the both sides can interflow at separate positions. In addition, it is not required that the interflow is provided symmetrically.

In this third embodiment, a description is provided of a microfluidic system 1E in which a liquid LB delivered from both sides interflow at respective different positions.

Figure 20:
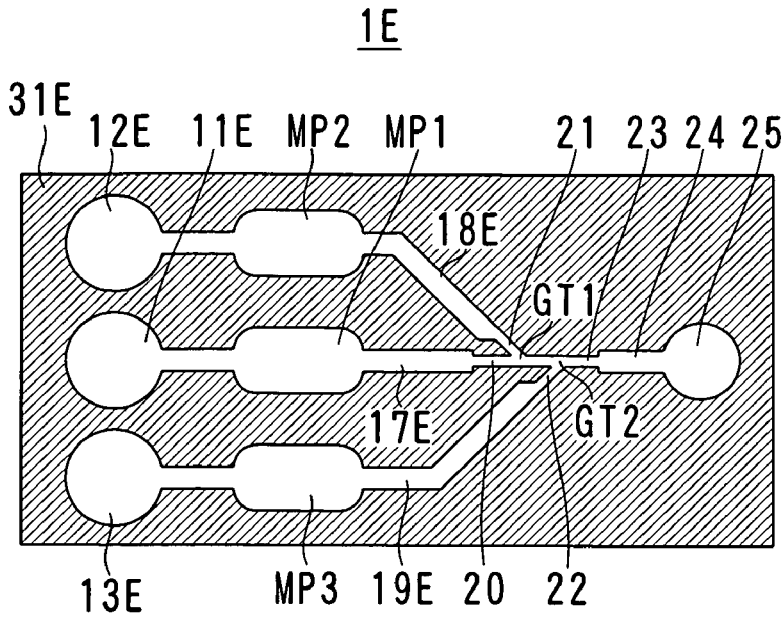
FIG. 20 is a plan view showing a structure of a microfluidic system according to a third embodiment.
Figure 21:
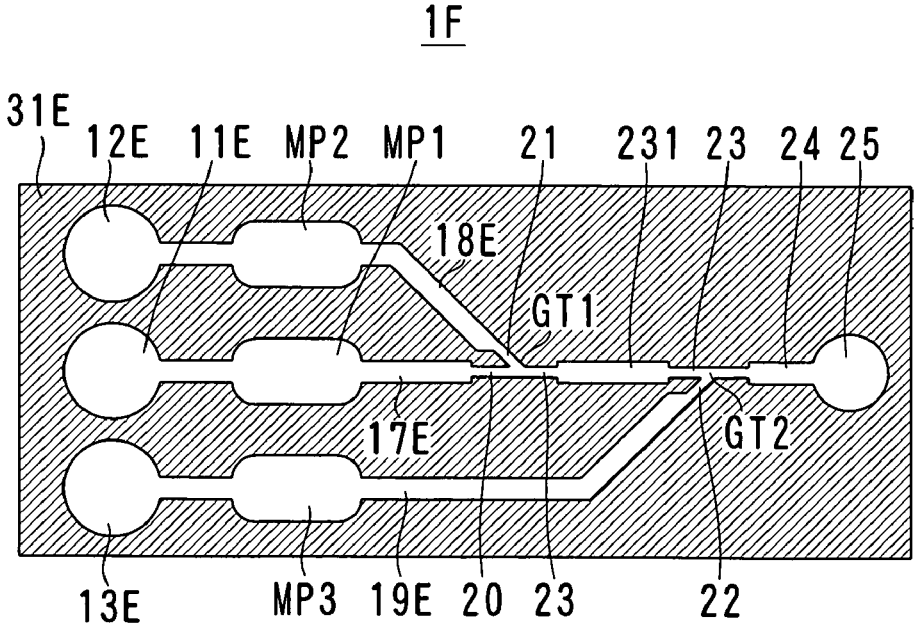
FIG. 21 is a plan view showing a microfluidic system according to an embodiment modified by the third embodiment.

FIG. 20 is a plan view schematically showing a structure of the microfluidic system 1E according to the third embodiment of the present invention, and FIG. 21 is a plan view schematically showing a structure of a microfluidic system 1F that is a modified example of the third embodiment.

Referring to FIG. 20, a liquid LA having a low mixing rate is transported from the middle narrow channel 20, while a liquid LB having a high mixing rate is transported from each of the narrow channels 21 and 22 located on the both sides of the narrow channel 20. The liquid LA may be transported by drive using a drive voltage having a constant drive waveform with no pulses, or may be transported intermittently by drive using a drive voltage with pulses. The liquid LB is transported intermittently by drive using a drive voltage with pulses. The liquid LB delivered from the narrow channels 21 and 22 at one time has a volume a little greater than a capacity of spaces of confluences GT1 and GT2, respectively.

Such drive divides the liquid LA having a low mixing rate every time when the liquid LB is delivered from the both sides alternately. The micropumps MP2 and MP3 may be driven by switching from one to the other at the same timing. Alternatively, the micropumps MP2 and MP3 may be driven by changing the timing for switching by a predetermined phase difference.

When the micropumps MP2 and MP3 are switched at the same timing for drive, the liquid LB is divided at the two confluences GT1 and GT2. Accordingly, the liquid LB that flows between the confluences GT1 and GT2 and has a minute volume becomes a bunch of laminar stream. It is highly possible that one laminar stream produces an asymmetrical shape in the narrow channel 23 or the channel 24. However, a balance is provided on both sides between the laminar stream, the previous laminar stream and the subsequent laminar stream. Thereby, as described with reference to FIG. 12, the liquid LB is not confined to the either left side or right side macroscopically and approximately uniform distribution can be obtained, ensuring that uniform diffusion and mixing can be performed at high speed.

Additionally, the switching timings of the micropumps MP1, MP2 and MP3 are set to suitable timings by matching the switching period of the middle micropump MP1 with the switching period of each of the micropumps MP2 and MP3 or by setting the relationship between the switching period of the middle micropump MP1 and the switching period of each of the micropumps MP2 and MP3 to be integral multiple. Thereby, plural kinds of liquids can be mixed under various states.

Referring to FIG. 21, the microfluidic system 1F is provided with a wide channel 231 with being sandwiched between the narrow channel 23 on the confluence GT1 side and the narrow channel 23 on the confluence GT2 side. In such a structure, liquids that have flowed together at the confluence GT1 are mixed in the channel 231 to some extent, and subsequently, a liquid flowing from the narrow channel 22 joins together at the confluence GT2. After that, the entire liquids are mixed in the channel 24.

In each of the embodiments discussed above, mixing of two kinds of liquids is mainly described. The embodiments can apply to mixing of three kinds of liquids or to mixing four or more kinds of liquids. For example, in the basic structure of the microfluidic system 1 as shown in FIG. 1, a structure is possible in which different liquids are supplied to or prepared in the three ports 11-13 respectively and the middle pump is driven intermittently or continuously between intervals of alternate drive of the micropumps MP2 and MP3 located on the both sides of the middle pump.

According to each of the foregoing embodiments, a drive waveform to be applied to each of the piezoelectric elements 34 is a waveform of alternate drive (pulse waveform) as mainly shown in FIGS. 8 and 9. Instead, other drive waveforms may be applied to the piezoelectric elements 34, such as drive waveforms having overlapping portions in a time scale or drive waveforms having time when all the micropumps MP are driven by a low voltage. In addition, it is possible that one micropump MP is constantly driven in a continuous manner and only the other micropumps MP are driven by switching the drive voltage levels.

When one of plural kinds of liquids has a high viscosity, or when one of plural kinds of liquids has physical properties that easily change as time passes after mixing, channel walls easily influence the liquid in the case of mixing using two channels positioned on both sides as in conventional cases. In contrast, according to the embodiments described above, such a liquid interflows from a middle channel, ensuring that the above-mentioned influence as the problem in the conventional cases can be relieved.

In the foregoing embodiments, valveless micropumps MP are used as liquid transport means. However, other liquid transport means can be used instead of the valveless micropumps. A micropump with a movable valve or an external large syringe pump may be used, for example. In this regard however, since flow rates of liquids are needed to be switched at high speeds (in the first embodiment, the switching time is 5-10 ms), a small micropump is desirable which has good responsiveness and can be built into a position close to a confluence GT in a high-density manner, as described in the foregoing embodiments.

In the embodiments discussed above, all the micropumps MP are equal to one another in shape. Instead, it is possible to differentiate the shape of the micropumps and the channels leading to the confluence GT between a micropump for a liquid having a high mixing rate and a micropump for a liquid having a low mixing rate.

If all the micropumps MP have the identical shape, slight change of a drive voltage causes amount of liquid transport of a liquid having a low mixing rate to change largely. As a countermeasure therefor, a structure is adopted in which a micropump MP for a liquid having a low mixing rate is hard to reverse the flow (has a small flow rate of backflow per unit pressure) compared to a micropump MP for a liquid having a high mixing rate, supposing that a pressure is placed in the backflow direction when not driven. Such a structure enables variation in mixing ratio to be reduced. More specifically, measures may be taken of narrowing channel cross section so that the former (the micropump MP for a liquid having a low mixing rate) has a channel resistance value of the micropump and the channel larger than that of the latter (the micropump MP for a liquid having a high mixing rate).

In the foregoing embodiments, the channel 17 or the narrow channel 20 in the present embodiments correspond to a first channel according to the present invention. The channels 18 and 19 or the narrow channels 21 and 22 correspond to a second channel according to the present invention. The narrow channel 23 and the confluence GT correspond to a third channel and a confluent portion of the present invention, respectively. Further, the micropump MP1 in the present embodiments is equivalent to a first pump in the present invention and, the micropumps MP2 and MP3 in the present embodiments are equivalent to a second pump in the present invention. The microfluidic systems 1E and 1F in the third embodiment are equivalent to a mixing system as recited in claim 10.

Structures, shapes, dimensions, numbers and materials of each part or whole part of the microfluidic system can be varied within the scope of the present invention.

The microfluidic system discussed above can apply to reactions in various fields including environment, food product, biochemistry, immunology, hematology, a genetic analysis, a synthesis and drug development. Further, the microfluidic system can also be used to dilute fuel for miniaturized fuel cell (methanol, for example) with water. Especially, the microfluidic system has an application for diluting a sample or a specimen with a dilute solution when two liquids have mixing ratios totally different from each other. In such an application, a dilution ratio exceeds ten times in many cases. Accordingly, the present invention has high industrial applicability or effectiveness.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for mixing at least two liquids transported in respective channels, the method comprising:

transporting, of the two liquids, a liquid having a low mixing rate intermittently in one of the channels; and transporting, of the two liquids, a liquid having a high mixing rate so as to join the liquid having a low mixing rate at an oblique angle from both sides of the channel for the liquid having a low mixing rate.

2. The method according to claim 1, wherein the liquid having a high mixing rate is transported from two symmetrical channels with respect to a confluent portion with the channel for the liquid having a low mixing rate and the liquid having a high mixing rate is transported from the two symmetrical channels by an equal amount.

3. The method according to claim 1, wherein the liquid having a high mixing rate is transported so as to join the liquid having a low mixing rate at two positions of the channel for the liquid having a low mixing rate, the two positions being different from each other.

4. The method according to claim 1, wherein the liquid having a low mixing rate and the liquid having a high mixing rate are transported through respective narrow channels in the vicinity of a confluent portion.

5. The method according to claim 4, wherein a volume of the liquid having a low mixing rate being intermittently transported at one time is greater than a volume of the confluence portion.

6. The method according to claim 1, wherein the transporting of the liquid having a low mixing rate and the transporting of the liquid having a high mixing rate are performed by respective micropumps, each micropump using the channel resistance characteristics of an opening connected to a chamber of the micropump.

7. The method according to claim 6, wherein the transporting of the liquid having a low mixing rate and the transporting of the liquid having a high mixing rate are alternately performed by respective micropumps, the micropump not operating for liquid transport being operated slightly by a micro drive voltage.

* * * * *